US005497515A

United States Patent [19]

Mohrman

[11] Patent Number: 5,497,515

[45] Date of Patent: Mar. 12, 1996

[54] TOILET BOWL WATER FLUSH SYSTEM

[76] Inventor: John H. Mohrman, 301 Village Rd., Orwigsburg, Pa. 17961

[21] Appl. No.: 391,359

[22] Filed: Feb. 21, 1995

[51] Int. Cl.[6] ..... E03D 11/08

[52] U.S. Cl. ..... 4/420

[58] Field of Search ..... 4/321, 420, 421

[56] References Cited

U.S. PATENT DOCUMENTS

| | | | |
|---|---|---|---|
| 158,896 | 1/1875 | Brinckerhoff | 4/420 |
| 442,177 | 12/1890 | Gibson | 4/420 |
| 524,246 | 8/1894 | Garland | 4/420 |
| 2,182,979 | 12/1939 | Bruzenak | 4/420 X |
| 5,271,105 | 12/1993 | Tyler | 4/431 |

FOREIGN PATENT DOCUMENTS

| | | | |
|---|---|---|---|
| 0009628 | of 1889 | United Kingdom | 4/420 |
| 0030036 | of 1914 | United Kingdom | 4/420 |

*Primary Examiner*—Robert M. Fetsuga
*Attorney, Agent, or Firm*—A. R. Eglington

[57] ABSTRACT

In a water flushing system for a toilet bowl which has been modified to replace the ovoid closed channel which supplies flushing water to the bowl inner sidewalls, there is now substituted a water dispersal conduit assembly adapted to be mounted within the recessed arcuate corner defined by the underside of the ovoid bowl toilet seat ledge and its juncture with the bowl upper sidewalls. The assembly directs water surges from the reserve tank about the bowl periphery and provides same with substantially uniform water impingement on the upper and inner sidewalls. The assembly is readily dismounted from sidewall support buttresses and then broken down for component cleaning and replacement, as required.

7 Claims, 3 Drawing Sheets

TOILET BOWL WATER FLUSH SYSTEM

CROSS REFERENCE TO EARLIER FILINGS

A Filing Under The Document Disclosure Program, accorded No. 367,504 on Dec. 23, 1994.

FIELD OF THE INVENTION

This invention relates to an improved method of flushing the conventional water flush-type toilet bowl in common use throughout the world.

DESCRIPTION OF PRIOR ART

Heretofore, conventional water flush-type toilets employed the means of causing the water released from the standard water tank to enter the bowl through castings formed within interior sections of the bowl, a rear chamber conduit and ports located within the oval bowl rim and top seat support. Those conduits serve to allow the water to flush the bowl by flowing through equally spaced-apart formed conduits located around the oval shaped circle comprising the cast top seat support and continuing onto the inclined surface of the toilet bowl. The identical diametrical size of those ports also cause an unequal flow of flush water over the bowl surface. Because of that equal sizing, most of the flush water flows through the ports closest to the inflow from the rear chamber. In addition, silt, unfiltered matter and bacteria will enter those conduit ports from the water supply or from reflux of bacteria and liquified waste within the toilet bowl. Because of the relatively rough inner surface of the conduit cavities and the outer area of the ports that do not contain a smooth porcelainized finish, a build-up of contaminants could occur. A hand mirror reflection of the normally concealed under ledge of a toilet bowl will graphically display the deposition ring of water-borne contaminants and mineral matter. Although many pathogenic microorganisms are killed by exposure to light and air, according to medical authorities, such conditions do not exist within those conduit cavities just described. Those conduit cavities could serve as an incubator for disease-carrying bacteria, especially under circumstances when an elevated toilet temperature was appropriate to cause such bacterial incubation to take place. Sterilization of those conduit cavities and apertures is not possible, because no means of practical access to such conduits exist. As public policy and regulatory measures for sanitation have improved since that antiquated water flushing system was devised, no means exist for cleansing of the interior cast waterways. Flushing with sterilizing chemicals to maintain a disease-free toilet is not favored since such chemicals are carried into various waste treatment facilities. Those sanitizing chemicals have a retarding affect on the bacterial action that must occur to treat the waste and to change the chemical composition of such waste in all types of sewage treatment facilities.

Manufacturers of those toilets continue to employ the same antiquated, technically, time-consuming and expensive methods to produce and market those type toilets for use, since no sanitary method of cleansing the toilet bowl with water had been provided until now. Governmental agencies, regulating public health and sanitation, continue to accept the current conventional water flush-type toilet as being the best available until the subject invention evolved. No other system is in use currently that will insure that use of the water flush-type toilet bowl can be maintained in a clean and sanitary condition.

SUMMARY OF THE INVENTION

The purpose of the present invention is to improve the method of sanitizing the toilet bowl with water in flush-type toilets. The improved configuration is similar to the water flush-type toilets currently in use, except the toilet bowl has been modified to a simpler and lest costly means of manufacture. Essentially, the rear water tank support area of the toilet now consists of a discrete water conduit assembly, inflow system and a smaller, vertical and horizontal ledge solid ovoid seat support. The toilet configuration has been changed to allow the inflow conduits for the flush water to be locatable inside the toilet bowl, and to be installed in a manner that the components of the bowl flushing system can be dismantled and cleaned, as necessary. Reduction in the width of the vertical sidewalls (between inner and outer sides) of the toilet oval bowl seat support has been achieved through elimination of the cast interior water channel normally cast into the fabrication of the bowl proper.

Specifically, flush water now enters the bowl from the reserve tank through a slightly arcuate central conduit integral with the rear tank support area of the bowl casting. The proximal end of the conduit extending into the bowl end, is provided with a radial lug at the top arch, and a similar retractable radial lug at the bottom arch, which can be depressed so as to attach a tee-shaped conduit that accepts and allows flush water to flow in two directions. The tee-shaped conduit rim is positioned to apply compression on the plastic washer sufficient to prevent leakage of the flush water.

Two lengths of elongate symmetrical curved flush water conduits are attached to the orifices of the legs provided in the tee-shaped conduit, and are positioned thereon by providing matching reception slots in each of those elongate conduits with radial lugs. These may be molded to and adjacent to each opening of the tee-shaped conduit. The elongate conduits are configured to fit the lateral, arcuate, sidewalls forming the inside of the bowl, and are supported by a multiplicity of triangular side-shaped, buttress supports. Such buttress supports are concavely curved at the top to accept and hold the conduits.

Each section of elongate arcuate water flush pipe conduit is capped at the elongate longitudinal end which is adjacent the frontmost interior of the bowl. Each section of elongated arcuate water flush pipe conduit, the end caps and the tee-shaped conduit is also provided with flow directional ports serving to facilitate complete coverage of the bowl sidewalls by the flushing water. The directional angle of those inlet conduit ports reduces the possibility of liquified waste depositing on the interior of the other system component parts. The overall size of the ports vary in graduated sizes from the back to the front of the toilet bowl, so as to cause comparable amounts of the flush water to be impinging over the entire bowl surface.

The present improved toilet bowl water flush system provides an efficient means of utilizing a separate conduit assembly for enhanced water inflow patterns to flush the toilet bowl sidewalls.

BRIEF DESCRIPTION OF THE DRAWINGS

FIG. 1O is a bottom view (looking upward), broken-out and enlarged, of a section of one arcuate elongated flush conduit, showing the graduating width sizes of the water inlet ports, with the smaller of said ports located proximal the rearmost rim of the bowl and the progression toward larger ports, located toward the frontmost rim of the toilet bowl;

DETAILED DESCRIPTION OF A PREFERRED EMBODIMENT OF THE INVENTION

Figure 1:
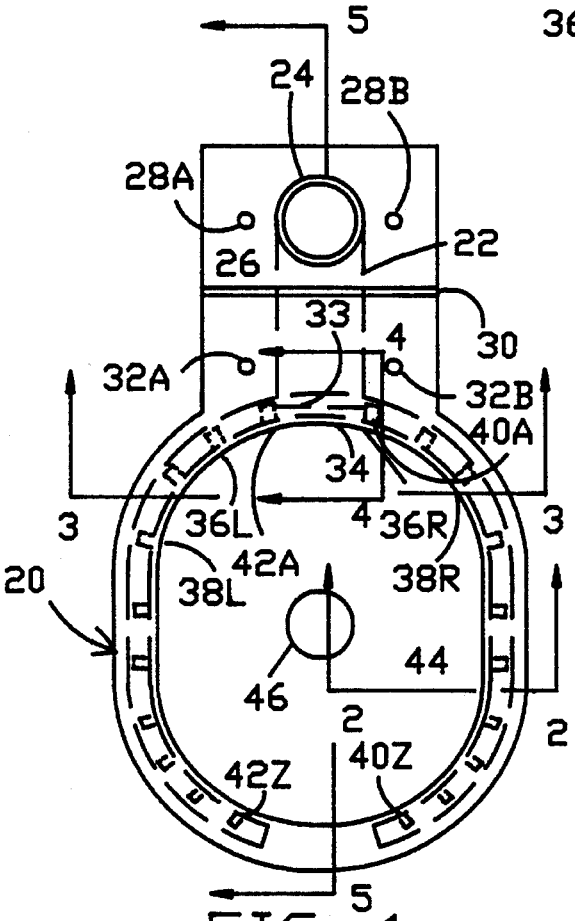
FIG. 1 is a top plan view of a sanitary toilet omitting the water reservoir the water flush inlet orifice to the bowl; the reserve water tank, bolt-down openings; the toilet seat bolt-down openings; the transverse tank alignment support ridge; the toilet bowl proper with central outlet, and the flush water ports underside (in phantom), and the integral ovoid seat support ledge.

Referring now to the drawing, and to FIG. 1 in particular, there is shown all of the components of the improved, water flushing sanitary toilet of the present invention, generally designated 20, but omitting the standard size, overlying water reservoir still serving to make available, on demand, a preset volume of water which is directed via elongate water supply conduit 22 which fills through upper end orifice 24. The backmost planar platform 26 is provided with spaced-apart, bolt-down openings 28A/B for mounting the water tank. Transversely located, on platform 26 is the tank alignment ridge 30, and somewhat forwardly of that are the spaced-apart, bolt-down openings 32A/B for the omitted toilet seat itself. Central conduit 22 is engaged proximate the periphery of its outer circular rim 33 with the tubular stem of a tee-shaped union member 34, which also has outwardly projecting, somewhat reduced diameter, symmetrical conduit-like legs 36L/R. The legs are conjoined with a symmetrical pair of arcuate, elongate conduits 38L/R; each tee-leg being connected slidingly but firmly by the overlapping closure of the outer proximal circular rim of each elongate conduit, having a slightly smaller diameter outer periphery (rim) than the abutting tee-member 34 to provide a pressure fitted union.

As shown in phantom in this view, there is provided the rearmost two (40A/42A) of an array of spaced-apart ports; 40A–Z are in the right side conduit 38R; and 42A–Z are in the left side conduit 38L: all of which ports are located along the lowermost arch of each of the tubular elongate conduits. These ports are disposed to provide flushing water for impinging upon the upper sidewalls 44 of toilet bowl 20. Special features of the two opposing arrays of outlet ports will later be described in detail. Lastly, a centrally located, liquid outflow orifice 46 is provided at the lower convergence of the bowl sidewalls.

Figure 2:
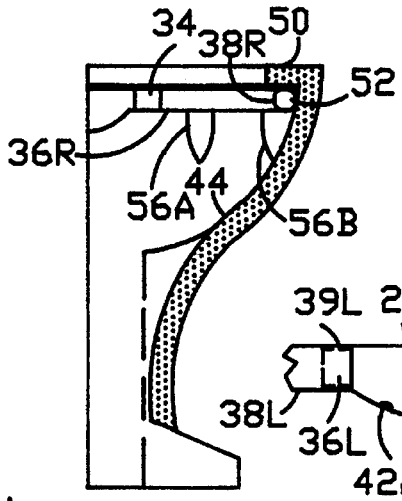
FIG. 2 is a partial, vertical sectional view of the right side, interior of the toilet bowl, showing the reduced width seat support ledge, certain functional components of the novel flush system, and at least two support buttresses, one for the right side (and another for the leftside), arcuate elongate water dispersal conduits; and the central lower outlet of the bowl, taken along line 2—2 of FIG. 1.

In the partial transverse vertical section view of FIG. 2, the somewhat concealed corner area of upper bowl sidewall configuration is seen. The improved toilet is provided with a reduced width, inwardly projecting, planar ledge 50 (normally serves to support the absent toilet seat itself). Ledge 50 defines the underside arcuate upper corner 52, along with the adjoining upper areas of the entire bowl sidewalls. Planar ledge 50 is narrowed somewhat, since it omits the closed liquid channel provided in prior art commodes which channel directs flushing water from the reservoir tank and directs the same upon the periphery of the inner bowl sidewalls. Note that planar ledge 50 is of a width sufficient to fully extend over the in-place elongate conduits (38).

Also seen is a vertical cross-section of right-side elongate conduit 36R, along with the rearmost segment of the rest of the same conduit. Underlying both of sectioned conduit 38R and its elongate portion are conduit support buttresses 56A and B, respectively conveniently, but not essentially, forming an integral fixture on the bowl sidewalls 44. If, as an integral fixture, it can be included in the casting process for the commode itself, by means well known in the toilet plumbing art, just as the here omitted ledge 50 closed channel (not seen) is provided for in the state of the art commodes.

Alternately, support buttresses like 56A can be separately fabricated and then mounted, by bonding or welding, at their appropriately high, inner sidewall positions, before the overall bowl is glazed and porcelainized.

Figure 3:
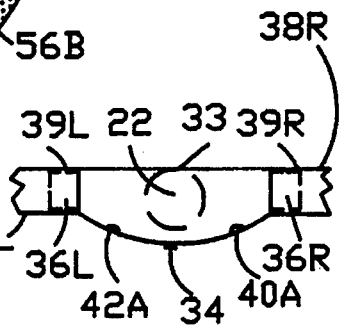
FIG. 3 is an enlarged, fragmentary elevational view of the Tee-shaped conduit of the water dispersal system, taken along line 3—3 of FIG. 1.

In the fragmentary end view of FIG. 3 there is provided another view of the manner of coupling of the tee-shaped union 34 concurrently with the rim 33 of inflow conduit 22, and with elongate conduits 38L/R, by having the latter two overlap the outermost periphery 39R/L of the tee-shaped union legs 36R/L. The rearmost ones of the underside water outlet ports, 40A and 42A, are located in the opposing legs of tee-union 34.

Figure 4:
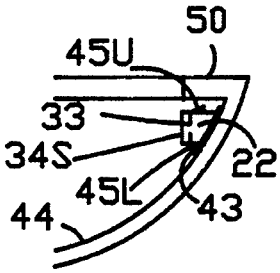
FIG. 4 is a fragmentary, enlarged side view of the protruding end of the water flush inlet conduit, a sidewall seating washer, the fragmentary edge of the tee-shaped conduit stem, the overlapping the water inlet conduit, with its top and bottom lugs (on the protruding water inlet conduit) and the locking slots in the Tee-shaped conduit notches to match those lugs.

In the fragmentary side view of FIG. 4, the mode of connection of the tee-shaped member stem 34S with the projecting end of inflow conduit 22 is seen. A flat O-ring, resilient washer 43 cushions the tee-stem circular rim against the sidewall 44. Also, a pair of diametrically-opposing radial lugs (45U/L) are provided proximal the outermost periphery of the tee-stem, which lugs are received by rectangular slots or recesses (not seen) in the circular outer periphery of the inflow pipe 34, which will be later detailed.

Figure 5:
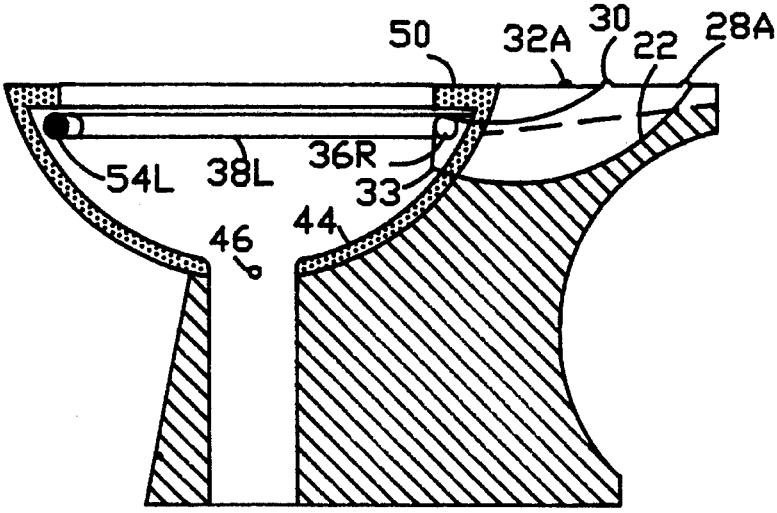
FIG. 5 is a vertical sectional view (front to back) of the entire bowl, depicting the seat support ledge, the arcuate flush water inlet conduit from the reserve tank, having its lowermost end protruding partially into the bowl proper; one sectioned arcuate elongate water dispersal conduit and the other elongate water conduit; the toilet bowl sidewalls and a modified flush outlet conduit.

The vertical sectional view of FIG. 5 depicts the full, essentially horizontal length of arcuate and bowl integral water inflow conduit 22, which terminates projecting slightly within the confines of bowl sidewall 44, as well as showing the connecting full length of opposing conduit 38L, with its frontmost end closure means 54L. This modified bowl configuration is further provided with a substantially linear, liquid outlet orifice 46, being somewhat different from the S-shaped outlet conduits seen in prior art commodes.

Figure 6:
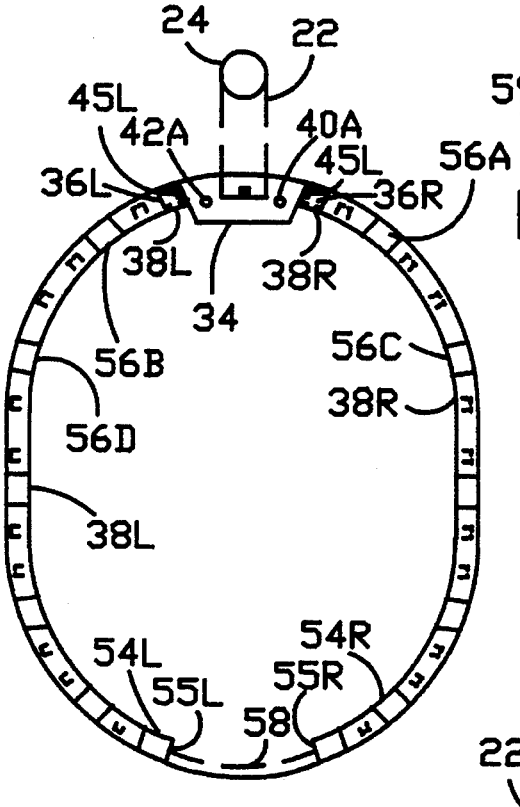
FIG. 6 is a bottom view (looking upwardly) of the improved toilet bowl assembly showing the flush water inlet conduit from the storage tank (in phantom), the Tee-shaped dispersal conduit with its latch mechanism; the complemental arcuate elongate water dispersal conduits with the opposing end caps; the water dispersal ports (in phantom) located along the elongate water dispersal conduit; the conduit aligning notches on the tee-shaped conduit, an inwardly projecting, elongate ridge, located adjacent the assembly at the frontmost part of the sidewalls; and plural spaced-apart buttresses for support of the opposing arcuate elongate dispersal conduits.

In the bottom plan view of FIG. 6 (as such would be seen looking up from the bowl outlet orifice 46), all of the operating elements of the improved bowl flushing system are to be seen. Inlet conduit 22 is fitted and latched onto the stem of tee-union 34; and each of symmetrical elongate conduits 38L/R are fitted and latched onto the union 34 legs 36L/R. The other longitudinal ends of conduits 38L/R are provided with endcaps 54L/R, which, in turn, are adapted to abut firmly upon the endwalls 55R/L of an elongate ridge 58. Ridge 58 is located along the frontmost arcuate segment of the inner and upper corner of the bowl sidewalls. Ridge 58 is inwardly projecting, and is horizontally aligned, having essentially flat endwalls (55R/L), positioned adjacent to the endcaps 54L/R. The ridge inclusion serves to arrest any forward shifting of the capped ends of the conduits, as would be expected to be induced by flushing water surges, normally occurring therethrough.

Also depicted, are the inclined open outer walls 59 of the several support buttresses 56A/B (FIG. 7), which undergird the elongate conduits. Lastly, it will be seen that the elongate array of outlet ports (40/42) provided in each conduit are graduated in orifice size, with the smaller orifices starting adjacent to the tee-shaped conduit 34 connection, and being graduated to having the larger orifices located proximal to the capped, frontmost ends of these conduits. The configuration and orientation of such orifices is seen in better detail, in the views of FIGS. 10 and 11.

Figure 7:
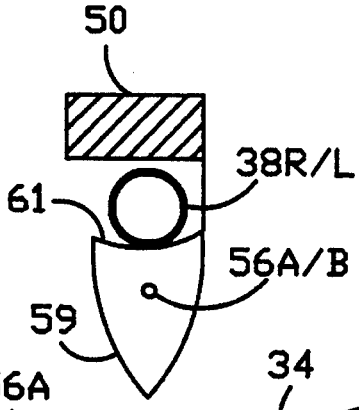
FIG. 7 is a broken-out, enlarged elevational view of a typical buttress suited for support of the elongate conduits, also showing the overlying seat support ledge and the lower bowl inner sidewall converging toward the central outlet conduit (not seen)

In the fragmentary side view of FIG. 7, the juxtaposition of either of the elongate conduits 38R/L is seen, as being disposed just below and adjacent to the solid cross-section of seating ledge 50, and being fully sheltered thereby. The support buttresses 56A/B are further provided with a concave upper surface 61, on which is adapted to rest firmly the elongate conduit 38R/L,, while in the operational posture.

Figure 8:
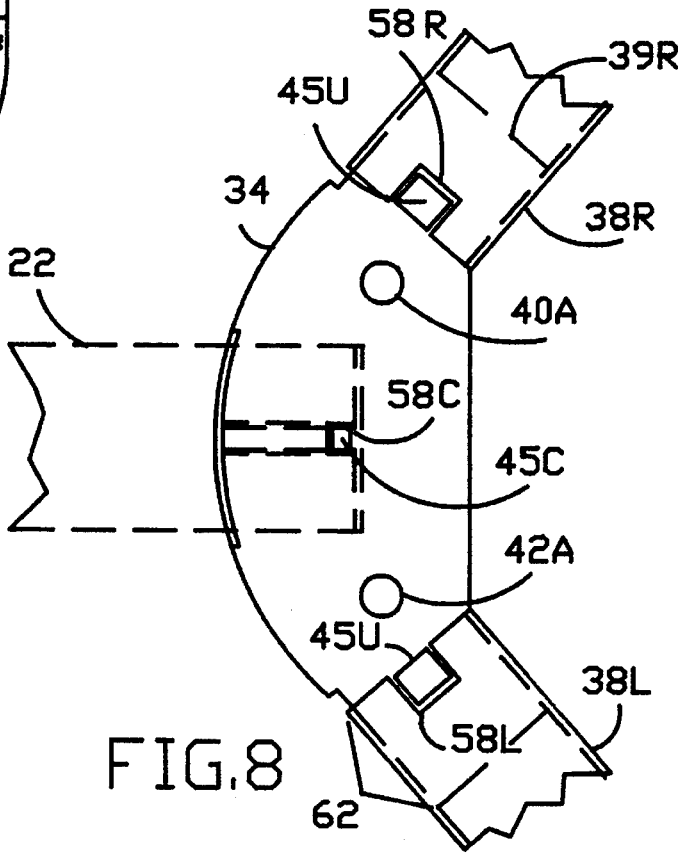
FIG. 8 is a broken-out, enlarged bottom view of the rearmost segment of the ledge periphery of FIG. 6, depicting the lugs on the tee-shaped conduits; the bowl conduit positioning slots, and the first (smallest size) of the curved array of dispersal ports located along the arcuate elongate conduit.

The enlarged fragmentary view of FIG. 8 is taken from that of FIG. 6, and depicts in detail, the nature of the projecting lug-in-rectangular slot latching feature 58L/R by which the coupling of the flow conduits is aligned and maintained in flushing operations. The significant cuff length 62 of the conduit ends overlap serves to minimize water outflow other than through the underarch port orifices.

Figure 9:
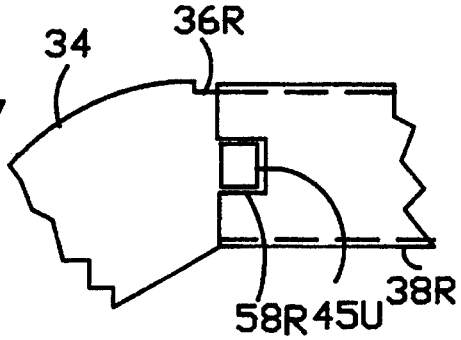
FIG. 9 is another fragmentary enlarged view of the union of the tee-member (based on FIG. 8) with the right side elongate conduit, showing the detail of the latching system.

In FIG. 9 is seen another fragmentary top view of the latching mechanism, in particular, for the tee-union 34 leg with right side elongate conduit 38R. Upper lug 45U is seated and retained in rigid slot 58R.

Figure 10:
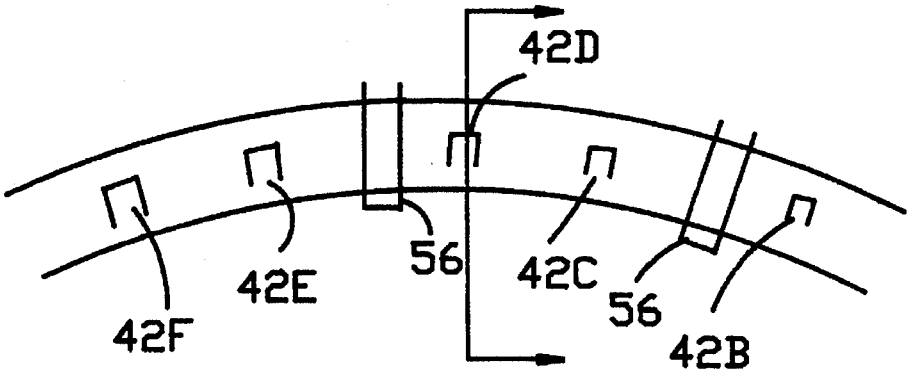
Figure 11:
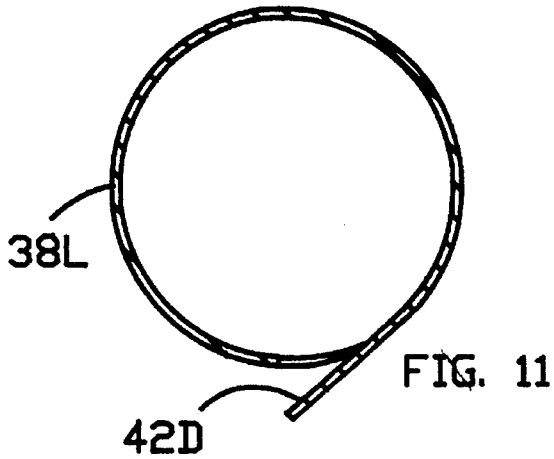
FIG. 11 is an enlarged, vertical sectional view of one elongate arcuate water conduit, showing one of the port-like, inclined apertures for directional water impingement upon the sidewall, taken along line 11—11 of FIG. 10.

The fragmentary enlarged bottom view of FIG. 10 depicts one arcuate segment of the underside arch of elongate conduit 38L, with the smallest port orifice (42B-C-D-etc.) being located proximal to the rearmost conduit end, and the largest port orifice (42E-F-G-H-etc.) being located proximal to the foremost conduit end. The array of ports 42 are seen in plan view, presenting a generally rectangular, flap-like structure to achieve directional flow of the flushing water impingement on the bowl sidewalls. In the transverse sectional view of FIG. 11, the configuration of a port outlet is better seen, such that it will provide a controlled water jet at a selected inclination against the uppermost bowl sidewall.

Figure 12:
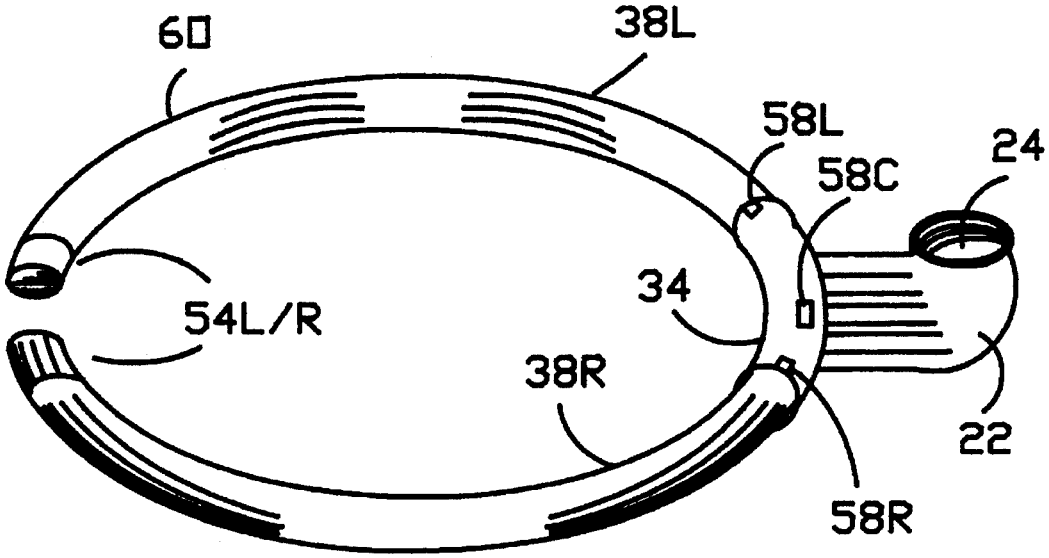
FIG. 12 is a perspective view of the entire water dispersal conduits assembly, standing apart from its bowl-mounted position, depicting all of the interconnected conduits through which the flush water from me storage water tank is first channeled and evenly dispersed upon inflow from thee underports.

In the perspective assembly view 60 Of FIG. 12, all of the improved water flushing system operating components are depicted, except for the underlying array of ports and conduit support buttresses, detailed above. When any flush system servicing is called for, the entire assembly can be withdrawn from service in the bowl, simply by reaching under the rearmost toilet ledge, grasping the tee-union, and manually withdrawing it from its latched jointure with a central water inlet pipe while bending the elongate members (38R/L) somewhat inwardly. With the assembly thusly separated from bowl engagement, the elongate members can be separated for cleaning and/or component replacement.

After servicing, the regenerated unit, is readily repositioned within the bowl sidewalls, resting on the support buttresses, and then is rejoined with the central water inflow conduit 22 in a proper juxtaposition, which is preset by the location of integral rim lugs and rim slots.

The gravitational swirl of descending flush water tends to flow or favor one side of the present and of this flush system. Using the dual elongated conduits instead of a complete loop conduits controls that inflow and causes a more even dispersal of flushwater.

I claim:

1. In a water flushing system for a toilet bowl which is normally comprised of an upstanding ovoid-shaped liquid receptacle having sidewalls and including a separable water volume reservoir available upon demand for supplying flushing water, a first water conduit connecting between said reservoir and the uppermost and inner periphery of the toilet bowl sidewalls, a substantially horizontal planar ledge forming an upper seat-support surface of said bowl, and a lowermost centrally located outlet orifice adapted for emptying of the bowl, the improvement comprising:

(a) the first water conduit is provided at a proximal end for projecting into the upper and inner periphery of said bowl sidewalls, and is located proximal to and below a rearmost segment of the planar ledge and normally presents its projecting end in a horizontal direction;

(b) a Tee-shaped conduit having its stem segment adapted to snugly engage the proximal projecting end of said first conduit and having its other open ends oriented outwardly and horizontally from the point of stem union;

(c) an arcuate, first elongate conduit connected fixedly to one of the open ends of said Tee-shaped conduit and configured to conform to the inner ovoid-shaped upper periphery of one lateral side of the bowl sidewalls and an underside of the bowl planar ledge, said conduit extending about substantially to the midpoint of a frontmost sidewall segment of the bowl inner periphery;

(d) an arcuate, second elongate conduit connected fixedly to the other open end of the Tee-shaped conduit and similarly configured to conform to the ovoid-shaped upper periphery of the other lateral side of the bowl sidewalls and the underside of the bowl planar edge and also extending substantially to the midpoint of said frontmost sidewall peripheral segment;

(e) a full closure means provided on the frontmost longitudinal end of each of said arcuate elongate conduits for precluding water egress from the frontmost conduit ends;

(f) a plurality of spaced-apart ports, arrayed axially of said elongate conduits and along a lowermost portion of each of, and further disposed to provide flush water outlets directed upon the sidewalls of said bowl; and (g) a plurality of inwardly projecting, horizontally-aligned, buttresses integral with and proximal to the bowl upper sidewalls which are also offset sufficiently from the underside of the bowl planar ledge and positioned to provide subjacent support to each of the arcuate elongate conduits when they are in their operational posture.

2. The improved flushing system of claim 1 wherein the first conduit projecting end, the Tee-shaped conduit, and the arcuate elongate conduits are all adapted to be conjoined at their abutting longitudinal ends by manual pressure.

3. The improved flushing system of claim 1 wherein the array of ports provided in each elongate conduit are graduated in orifice sizes with the smaller orifices being located proximal to the Tee-shaped conduit connection and being graduated to having the larger orifices located proximal to the closed longitudinal ends of each of said conduits.

4. The improved flushing system of claim 1 wherein the array of ports of said elongate conduits are configured to effect water impingement directly upon the adjacent bowl sidewalls.

5. The improved flushing system of claim 1 wherein the array of integral buttresses are each provided with a generally concave upper surface adapted to nest firmly the elongate conduits while they are in their operational posture.

6. The improved flushing system of claim 1 wherein the connection between the elongate conduits and Tee-shaped conduit includes an overlapping outer edge of the periphery of each of the elongate conduits having a recess, and the underlapping outer edge of the periphery of each of the opposing legs of the tee-shaped conduit having a single, radially-projecting rigid lug, with complemental pairs of recesses and lugs being adapted for retaining the conduits in their operational position.

7. The improved flushing system of claim 1 wherein the frontmost arcuate segment of the inner bowl periphery is provided with an inwardly projecting, horizontally aligned, elongate ridge having flat endwalls, which are adapted to arrest any forward shifting of the abutting capped ends of the elongate conduits, as such may be induced by water flow surges therethrough.

* * * * *